US007806228B2

(12) United States Patent
Dyck et al.

(10) Patent No.: US 7,806,228 B2
(45) Date of Patent: Oct. 5, 2010

(54) SINGLE DUCT SILENCING TERMINAL UNIT

(75) Inventors: Alfred Theodor Dyck, Winnipeg (CA); Duane McLennan, Winnipeg (CA); James William Patterson, Chicago, IL (US); Johann Joel Emile Baetsen, Winnipeg (CA); Bogna Gryc, East S. Paul (CA)

(73) Assignee: E.H. Price Ltd. (CA)

( * ) Notice: Subject to any disclaimer, the term of this patent is extended or adjusted under 35 U.S.C. 154(b) by 19 days.

(21) Appl. No.: 12/047,783

(22) Filed: Mar. 13, 2008

(65) Prior Publication Data

US 2008/0223652 A1 Sep. 18, 2008

Related U.S. Application Data

(60) Provisional application No. 60/895,153, filed on Mar. 16, 2007.

(51) Int. Cl.
*E04F 17/04* (2006.01)

(52) U.S. Cl. ..... 181/224; 181/252; 181/272; 181/256

(58) Field of Classification Search ..... 181/224, 181/252, 255, 272, 256
See application file for complete search history.

(56) References Cited

U.S. PATENT DOCUMENTS

| | | | | | |
|---|---|---|---|---|---|
| 2,808,896 | A | * | 10/1957 | Sigismond | 181/228 |
| 3,033,307 | A | * | 5/1962 | Sanders et al. | 181/224 |
| 3,511,336 | A | * | 5/1970 | Rink et al. | 181/224 |
| 4,287,962 | A | * | 9/1981 | Ingard et al. | 181/224 |
| 5,663,535 | A | | 9/1997 | MacDonlad | |
| 5,728,979 | A | * | 3/1998 | Yazici et al. | 181/224 |
| 5,869,792 | A | * | 2/1999 | Allen et al. | 181/224 |

OTHER PUBLICATIONS

Dimensions of Tested Prior Art Units—DIR-B, DIR-D.
Dimensions of Tested Prior Art Units—3'-B, 3'-D.
Dimensions of Tested Prior Art Units—TR-B, TR-D.

* cited by examiner

*Primary Examiner*—Jeffrey Donels
*Assistant Examiner*—Forrest M Phillips
(74) *Attorney, Agent, or Firm*—Smith, Gambrell & Russell

(57) ABSTRACT

An apparatus and method for attenuating the sound generated by a single duct terminal unit in an HVAC (heating, ventilating, and air conditioning) system. The apparatus utilizes internal geometry to minimize noise due to air disturbances and aerodynamic effects within the apparatus.

12 Claims, 2 Drawing Sheets

4
4
305
305
306
306
309
309
5
5
303
302
304
300
311
301
307
310
308
307

352
352
303
306
306

351
306
303
306
351

SINGLE DUCT SILENCING TERMINAL UNIT

CROSS REFERENCES TO RELATED APPLICATIONS

This application claims priority to U.S. provisional application No. 60/895,153, filed Mar. 16, 2007, which is incorporated herein by reference.

FIELD OF THE INVENTION

This invention relates to an integrated single duct silencing terminal unit for HVAC (heating, ventilating, and air conditioning) systems.

BACKGROUND OF THE INVENTION

Commercial HVAC systems have conventionally contained "Single Duct Terminal Units" ("SDTUs") for the purpose of providing an outlet for commercial ventilation systems into the rooms of a building or other structure equipped with an HVAC system. An SDTU typically consists of the following components: 1) inlet duct, 2) flow sensor, 3) modulation damper, and 4) insulated casing.

In commercial HVAC installations, a "silencer" (or "attenuator") is often placed downstream of an SDTU in order to attenuate the sound produced by the high-velocity air exiting the SDTU. Such silencers have typically comprised an air duct (typically from three to five feet in length) that is lined internally with insulation to attenuate the noise produced by the air flowing through the SDTU. Such internal insulation is also known as a "baffle" and is usually held in place by perforated sheet metal. The perforations in the metal allow the air traveling through the silencer to interact with the insulation material contained inside the baffle. The attenuation achieved by the silencer is due to the conversion of acoustic energy into heat energy as the air molecules inside the silencer create friction when they collide with the lined insulation.

The noise generated by an SDTU can be separated into two components: 1) noise due to the air disturbance created in the immediate vicinity of the damper blade and 2) aerodynamic noise due to the flow of air that has variable pressure regions interacting with geometry changes in the air stream. The insulation contained in silencers minimizes both sources of noise created by the SDTU, The noise generated by a given SDTU can vary widely depending on how it is utilized in a particular HVAC system and on the configuration of the HVAC system. Similarly, the acoustic performance of a given silencer can also vary widely depending upon the configuration of the HVAC system in which it is installed. Such unpredictability of the noise that will be generated by an SDTU and the attenuation achieved by a silencer is related to what is known as the "system effect" of the HVAC system in which the SDTU and silencer are installed. For instance, the manner in which the distribution ductwork is organized in a given building installation can affect the turbulence and air pressures created inside the ductwork. This, in turn, can affect the noise level generated by an SDTU and the acoustic performance achieved by a silencer attached thereto.

The unpredictability produced by such system effects creates uncertainty when HVAC installers are selecting SDTUs and silencers for installation in a building. Manufacturers of traditional SDTUs and silencers typically test their products under artificial laboratory conditions and produce specifications as to the noise generated by their SDTUs and the noise attenuation achieved by their silencers. However, these specifications do not take into account the system effects produced by installing their products in an actual HVAC system. Thus, HVAC installers generally have only marginally reliable product specifications on which they can rely and often must utilize trial-and-error methods to choose the appropriate combination of SDTUs and silencers that will meet their needs in a particular HVAC installation.

SUMMARY OF THE INVENTION

The invention (a single duct silencing terminal unit "SDSTU") involves an apparatus and method for attenuating the sound generated by a single duct terminal unit in a predictable and consistent manner. A further object of the invention is the integration of an SDTU and a silencer into a single unit, without any intervening ductwork connecting them. It is an object of the invention to minimize the total length of the SDSTU in comparison to the combined length of prior art SDTUs, silencers, and connecting ductwork. Another object of the invention is to attenuate sound to a greater degree than is possible with a combination of prior art SDTUs or silencers of a given size.

Embodiments of the invention reduce both the noise due to the air disturbances within the SDSTU and the self-generated aerodynamic noise by the unique internal geometry in the silencing portion of the SDSTU that minimizes both types of noise.

Some embodiments of the invention reduce noise due to the extended discharge length of the silencing portion of the SDSTU.

Some embodiments of the invention contain a wider casing surrounding the silencing portion of the SDSTU than found in prior art silencers.

Some embodiments of the invention include thicker insulation around the plenum of the SDSTU than prior art SDTUs and thus provide superior attenuation properties.

In some embodiments, the length of the "discharge region" following the inlet duct of the SDSTU is longer than in prior art SDTUs. This provides a longer length inside the plenum for the flowing air to transition from the high-pressure, high-velocity ductwork into the SDSTU. This, in turn, allows for less turbulence as the flowing air moves into the silencing portion of the SDSTU.

The plenum portion of the SDSTU is closely coupled to the silencing portion of the SDSTU in some embodiments. This helps minimize turbulence within the SDSTU and minimizes the overall length of the SDSTU in comparison to the prior art combination of an SDTU, silencer, and connecting ductwork.

Further objects, features and advantages will become apparent upon consideration of the following detailed description of the invention when taken in conjunction with the drawings and the appended claims.

DETAILED DESCRIPTION

Figure 1:
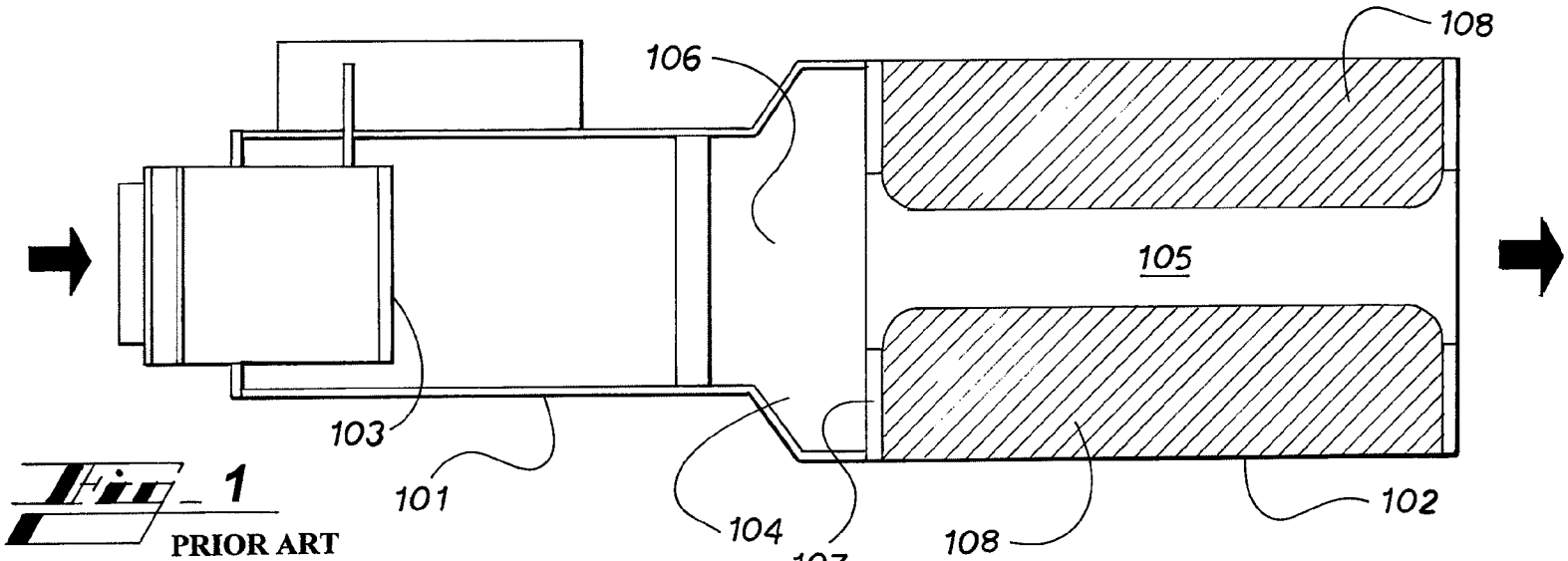
Fig. 1 PRIOR ART
FIG. 1 is a side cross-sectional view of a prior art SDTU close-coupled with a prior art silencer.

FIG. 1 is an illustration of the close-coupling of a prior art SDTU 101 with a prior art silencer 102. Such close-coupling of prior art SDTUs and silencers will produce unpredictable results because of the turbulence created when high velocity air exits the inlet duct 103 and enters the silencer 102. The wide area 104 created where the silencer 102 attaches to the SDTU 101 will create excess turbulence and noise. In addition, the cross-sectional area of the air pathway 105 of a prior art silencer 102 is typically narrower than the cross sectional area of the outlet 106 of the SDTU 101. Therefore a "nose" 107 is created where the air exiting the outlet 106 collides into the baffles 108 inside the silencer 103. This too causes added turbulence and increased noise. Such noise greatly exceeds that which would be predicted based on the manufacturer's noise specifications for the SDTU 101 and silencer 102 individually.

Figure 2:
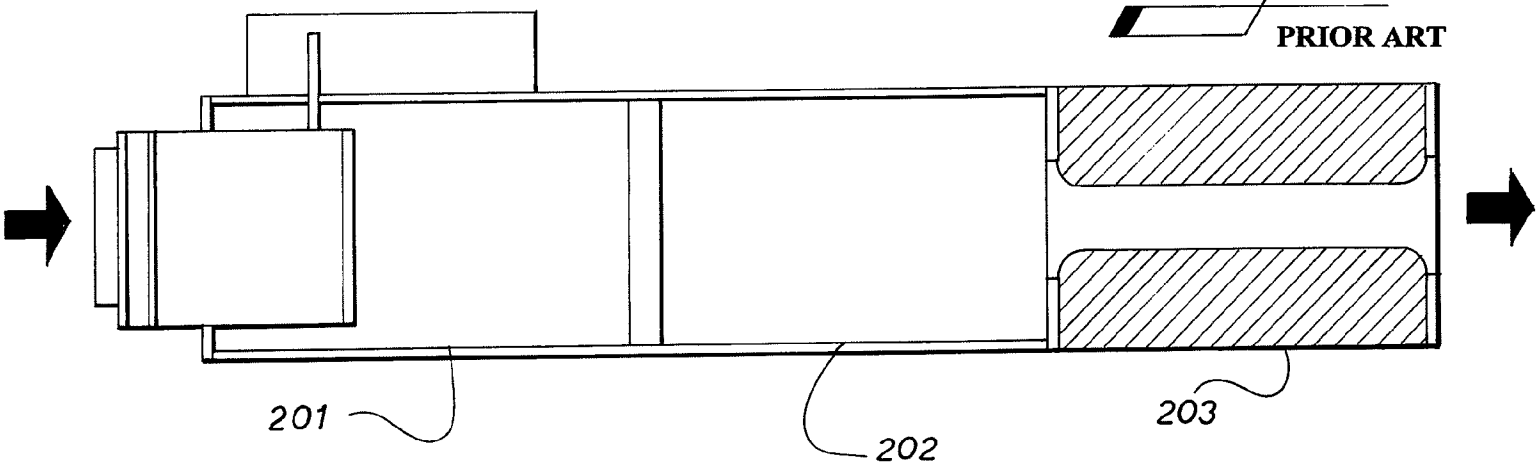
Fig. 2 PRIOR ART
FIG. 2 is a side cross-sectional view of a prior art SDTU connected to a prior art silencer by a three-foot long air duct that is lined internally with insulation.

FIG. 2 is an illustration of how prior art silencers are typically installed in an HVAC system. Because of the excess noise created by any attempt to closely couple a prior art silencer to an SDTU 201, installers will usually separate the SDTU 201 and the silencer 203 by a length of lined ductwork 202, typically one to three feet in length. While reducing the noise generated by the SDTU 201, this approach has the drawback of increased costs due to the extra ductwork and increased length of the overall unit. In addition, installers must use trial and error techniques to determine an appropriate length for the connecting ductwork 202. Furthermore, installers cannot generally rely on the manufacturer's noise specifications for the SDTUs or silencers.

Figures 3, 4, 5:
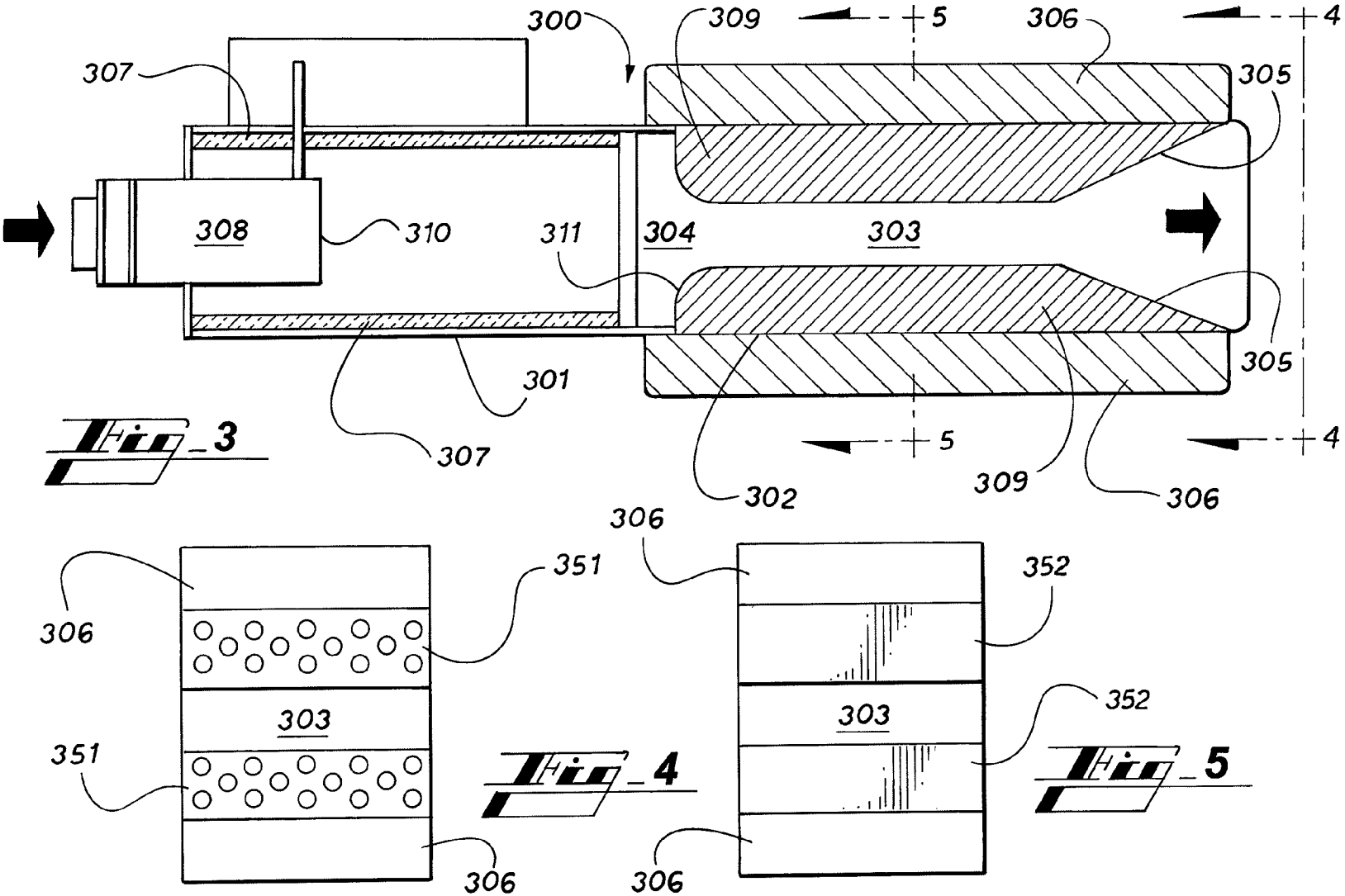
FIG. 3 is a side cross-sectional view of an SDSTU in accordance with the invention.
FIG. 4 an end view along the line labeled "4" of FIG. 3.
FIG. 5 a cross-sectional view along the line labeled "5" of FIG. 3.

FIG. 3 is a side cross-sectional view of an SDSTU 300 in accordance with an embodiment of the invention. The plenum portion 301 of the SDSTU 300 is directly attached to the silencing portion 302 of the SDSTU 300 with no intervening ductwork. This helps to minimize the overall size of the SDSTU 300.

The internal geometry of the silencing portion 302 of the SDSTU 300 is configured to minimize both the noise due to the air disturbances inside the SDSTU 300 and the self-generated aerodynamic noise of the SDSTU 300. Specifically, the silencing portion 302 of the SDSTU 300 has an air pathway 303 that is narrower than the inlet 304 into the silencing portion 302 of the SDSTU 300. The constricted air pathway 303 is configured to permit a maximum of 4500 feet per minute velocity of air flow through the SDSTU 300. Under optimal conditions, the flow rate through the SDSTU 300 will not exceed 3000 feet per minute.

This 3000 feet per minute velocity rate produces the optimal trade-off in terms of minimizing the combination of air disturbance noise and self-generated aerodynamic noise. Any further constriction of the air pathway 303 would increase self-generated aerodynamic noise more than it would attenuate the air disturbance noise. Conversely, any widening of the air pathway 303 would increase the air disturbance noise more than it would minimize the self-generated aerodynamic noise.

Baffles 309 in the silencing portion 302 of the SDSTU flare outward into a "tail" 305 in some embodiments of the invention. (In other embodiments, the baffles 309 are straight, thus providing a constant cross-sectional area for the air pathway 303.) This tail 305 allows the expanding air that is traveling down the air pathway 303 to maintain a constant pressure. This is because the increased cross-sectional area of the tail portion 305 of the SDSTU 300 provides additional space for the expanding gas to occupy, thus preventing a buildup of pressure within the SDSTU 300.

In some embodiments, the length of the silencing portion 302 of the SDSTU 300 is substantially longer than prior art silencers. This allows for greater attenuation of the noise generated at the SDSTU 300 by providing a longer air pathway 303 in which the air molecules flowing through the SDSTU 300 can interact with the baffles 309 of the silencing portion 302 of the SDSTU 300. The optimal size for such extended discharge length of the silencing portion 302 is up to thirty six inches.

Some embodiments of the invention contain extended casing 306 surrounding the silencing portion 302 of the SDSTU 300, making the silencing portion 302 wider than the plenum portion 301 of the SDSTU 300. This feature, not found in prior art silencer/SDTU combinations, allows for increased attenuation due to the additional insulation enclosed in the extended casing 306. The extended casing 306 can be up to 10 inches in thickness with an optimal thickness of six inches or less.

The plenum portion 301, in some embodiments of the invention, has thicker internal insulation 307 than prior art SDTUs. Such insulation provides more sound attenuation than the prior art. Such internal insulation can be up to two inches in thickness and up to four pounds in density. The optimal amount of insulation is up to an inch in thickness and up to 1.5 pounds in density.

Certain embodiments of the invention contain a longer plenum 301 than is found in prior art SDTUs. This extension of the plenum 301 provides a longer length of ductwork for the high-velocity, high-pressure air to exit the inlet duct 308 and transition into the lower pressure plenum 301 of the SDSTU 300 before entering the silencing portion 302 of the SDSTU 300. As a result, the flowing air will have less turbulence as it flows into the silencing portion 302 of the SDSTU 300. The optimal length of the plenum discharge region from the outlet 310 of the inlet duct 308 to the entrance 311 of the silencing portion 302 of the SDSTU 300 is up to 36 inches in length with an optimal length of 24 inches or less.

FIG. 4 depicts an end view of the silencing portion 302 of the SDSTU 300 and the perforated metal casing 351 that encloses the insulating material 352 of the baffles 309. FIG. 4 also shows the extended casing 306 surrounding the silencing portion 302 of the SDSTU 300.

FIG. 5 is a cross-sectional view of the insulating material 352 that comprises the baffles 309 of the silencing portion 302 of the SDSTU 300.

While this invention has been described with reference to the structures and processed disclosed, it is to be understood that variations and modifications can be affected within the spirit and scope of the invention as described herein and as described in the appended claims.

We claim:

1. A single duct silencing terminal unit comprising:

a plenum surrounded by a first casing and containing an inlet duct;

a silencing portion surrounded by a second casing and containing at least one baffle;

wherein said plenum contains an outlet;

wherein said silencing portion contains an inlet and an outlet;

wherein said outlet of said plenum is directly coupled to the inlet of said silencing portion;

wherein said first casing has a substantially uniform cross-sectional area throughout the length of the plenum;

wherein said second casing has a substantially uniform cross-sectional area throughout the length of the silencing portion;

wherein the cross-sectional area of the first casing is substantially equal to the cross-sectional area of the second casing; and wherein the distance from the outlet of said inlet duct to the inlet of said silencing portion is between about 12 inches and about 36 inches.

2. The single duct silencing terminal unit of claim 1 wherein the distance from the outlet of said inlet duct to the inlet of said silencing portion is between about 12 inches and about 24 inches.

3. The single duct silencing terminal unit of claim 1 wherein the distance from the outlet of said inlet duct to the inlet of said silencing portion is about 19½ inches.

4. The single duct silencing terminal unit of claim 1 wherein the plenum is lined with internal insulation between about 0.75 inches and about 2 inches in thickness.

5. The single duct silencing terminal unit of claim 1 wherein the plenum is lined with internal insulation between about 0.75 inches and about 1 inch in thickness.

6. The single duct silencing terminal unit of claim 1 wherein the plenum is lined with internal insulation about 1 inch in thickness.

7. The single duct silencing terminal unit of claim 2 wherein the plenum is lined with internal insulation between about 0.75 inches and about 2 inches in thickness.

8. The single duct silencing terminal unit of claim 2 wherein the plenum is lined with internal insulation between about 0.75 inches and about 1 inch in thickness.

9. The single duct silencing terminal unit of claim 2 wherein the plenum is lined with internal insulation about 1 inch in thickness.

10. The single duct silencing terminal unit of claim 3 wherein the plenum is lined with internal insulation between about 0.75 inches and about 2 inches in thickness.

11. The single duct silencing terminal unit of claim 3 wherein the plenum is lined with internal insulation between about 0.75 inches and about 1 inch in thickness.

12. The single duct silencing terminal unit of claim 3 wherein the plenum is lined with internal insulation about 1 inch in thickness.

* * * * *

US007806228C1

(12) EX PARTE REEXAMINATION CERTIFICATE (10908th)

United States Patent
Dyck et al.

(10) Number: US 7,806,228 C1
(45) Certificate Issued: Jul. 19, 2016

(54) SINGLE DUCT SILENCING TERMINAL UNIT

(75) Inventors: Alfred Theodor Dyck, Winnipeg (CA); Duane McLennan, Winnipeg (CA); James William Patterson, Chicago, IL (US); Johann Joel Emile Baetsen, Winnipeg (CA); Bogna Grye, East S. Paul (CA)

(73) Assignee: E.H. PRICE LTD., Winnipeg, Manitoba (CA)

Reexamination Request:
No. 90/013,584, Sep. 10, 2015

Reexamination Certificate for:

| | |
|---|---|
| Patent No.: | **7,806,228** |
| Issued: | **Oct. 5, 2010** |
| Appl. No.: | **12/047,783** |
| Filed: | **Mar. 13, 2008** |

Related U.S. Application Data

(60) Provisional application No. 60/895,153, filed on Mar. 16, 2007.

(51) Int. Cl.

| | |
|---|---|
| ***E04F 17/04*** | (2006.01) |
| ***F24F 13/02*** | (2006.01) |
| ***F24F 13/24*** | (2006.01) |

(52) U.S. Cl.
CPC ..... *E04F 17/04* (2013.01); *F24F 13/02* (2013.01); *F24F 13/0263* (2013.01); *F24F 13/24* (2013.01)

(58) Field of Classification Search
None
See application file for complete search history.

(56) References Cited

To view the complete listing of prior art documents cited during the proceeding for Reexamination Control Number 90/013,584, please refer to the USPTO's public Patent Application Information Retrieval (PAIR) system under the Display References tab.

*Primary Examiner* — William Doerrler

(57) ABSTRACT

An apparatus and method for attenuating the sound generated by a single duct terminal unit in an HVAC (heating, ventilating, and air conditioning) system. The apparatus utilizes internal geometry to minimize noise due to air disturbances and aerodynamic effects within the apparatus.

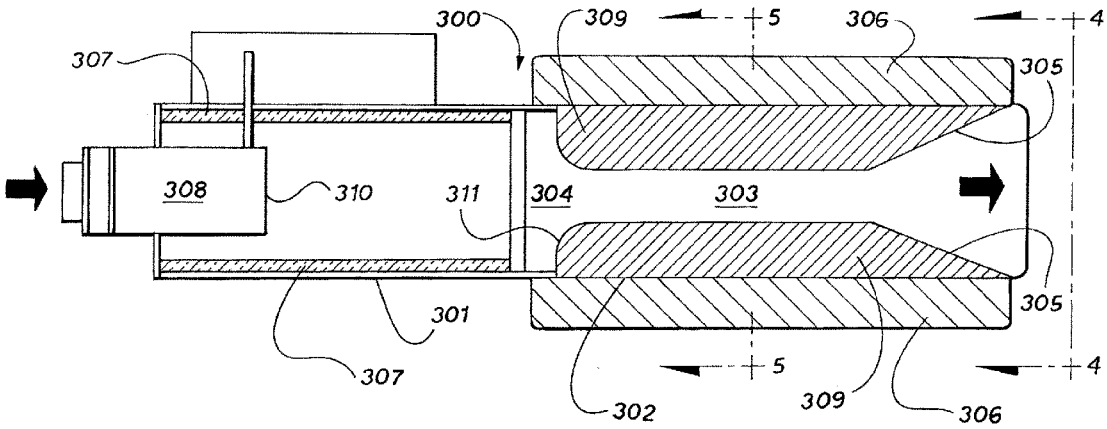

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-12 are cancelled.

* * * * *